US011747092B2

(12) United States Patent
Chen et al.

(10) Patent No.: US 11,747,092 B2
(45) **Date of Patent: *Sep. 5, 2023**

(54) VAPOR CHAMBER AND HEAT DISSIPATION DEVICE WITH SAME

(71) Applicant: AURAS Technology Co., Ltd., New Taipei (TW)

(72) Inventors: Chih-Wei Chen, New Taipei (TW); Chien-Fu Liu, New Taipei (TW); Guan-Cing Liu, New Taipei (TW)

(73) Assignee: AURAS TECHNOLOGY CO., LTD., New Taipei (TW)

( * ) Notice: Subject to any disclaimer, the term of this patent is extended or adjusted under 35 U.S.C. 154(b) by 0 days.

This patent is subject to a terminal disclaimer.

(21) Appl. No.: 17/889,665

(22) Filed: Aug. 17, 2022

(65) Prior Publication Data

US 2022/0390184 A1 Dec. 8, 2022

Related U.S. Application Data

(62) Division of application No. 16/733,862, filed on Jan. 3, 2020, now Pat. No. 11,454,455.

(30) Foreign Application Priority Data

Jan. 31, 2019 (TW) ..... 108103904

(51) Int. Cl.
*F28D 15/04* (2006.01)

(52) U.S. Cl.
CPC ..... *F28D 15/04* (2013.01)

(58) Field of Classification Search
CPC ..... F28D 15/04; F28D 15/046; H05K 7/2029; H05K 7/20336
USPC ..... 165/104.26
See application file for complete search history.

(56) References Cited

U.S. PATENT DOCUMENTS 4,118,756 A * 10/1978 Nelson ..... H05K 1/0272 165/104.33
6,269,866 B1 * 8/2001 Yamamoto ..... F28D 15/0233 174/15.2
6,293,332 B2 * 9/2001 Li ..... F28D 15/0233 165/104.33
7,025,124 B2 * 4/2006 Wang ..... F28D 15/046 165/104.21
7,770,631 B2 * 8/2010 Wang ..... F28D 15/0233 165/104.21
10,018,427 B2 * 7/2018 Lin ..... H01L 23/427
(Continued)

*Primary Examiner* — Tho V Duong
(74) *Attorney, Agent, or Firm* — WPAT, P.C

(57) ABSTRACT

A vapor chamber and a heat dissipation device with the vapor chamber are provided. The vapor chamber includes a first plate, a second plate, a first capillary strip, a first communication structure and a working medium. An accommodation space is defined by the first plate and the second plate collaboratively. The first capillary strip is installed in the accommodation space. The accommodation space is divided into a first region and a second region by the first capillary strip. The working medium is accommodated within the accommodation space. The working medium flows between the first region and the second region through the first communication structure. Since the working medium is guided to flow in the accommodation space by the first capillary strip and the first communication structure, the heat dissipating efficacy is enhanced.

18 Claims, 16 Drawing Sheets

(56) References Cited

U.S. PATENT DOCUMENTS

| | | | | |
|---|---|---|---|---|
| 10,352,626 | B2 * | 7/2019 | Kurashima | F28D 15/046 |
| 2011/0192576 | A1 * | 8/2011 | Wang | F28D 15/04 165/104.26 |

* cited by examiner

VAPOR CHAMBER AND HEAT DISSIPATION DEVICE WITH SAME

RELATED APPLICATIONS

This present application is a Divisional Application of the U.S. application Ser. No. 16/733,862, filed Jan. 3, 2020, which claims priority to Taiwan Application Serial Number 108103904, filed Jan. 31, 2019, all of which are herein incorporated by reference.

FIELD OF THE INVENTION

The present invention relates to a heat dissipation device, and more particularly to a vapor chamber and a heat dissipation device with the vapor chamber.

BACKGROUND OF THE INVENTION

Generally, many processor chips and image processing chips are installed in a computer. During the operations of these chips, a great deal of heat is generated and the temperature is largely increased. For preventing from the damage of these chips, the computer is usually equipped with a heat dissipation device to remove the heat. For example, the heat dissipation device comprises a vapor chamber. The vapor chamber is in thermal contact with the chip. After the heat generated by the chip is transferred to the vapor chamber, the heat is carried away from the chip by the working medium within the vapor chamber. Moreover, the heat is released from the working medium. Consequently, the chip and the neighboring sites can be maintained at the appropriate temperature.

Conventionally, the vapor chamber is a heat pipe with a vacant space therein. The working medium is accommodated within the vacant space. After the heat from the chip is absorbed by the working medium, the working medium is scattered in the vacant space in all directions. If the working medium is scattered to the position that is difficult to remove the heat or the vapor chamber is shared by plural chips, the heat cannot be effectively dissipated away by the working medium. In other words, the conventional vapor chamber needs to be further improved.

SUMMARY OF THE INVENTION

For solving the drawbacks of the conventional technologies, the present invention provides a vapor chamber and a heat dissipation device with the vapor chamber. Consequently, the speed of releasing the heat from the working medium is increased, the temperature within the vapor chamber is distributed uniformly, and the heat-dissipating efficacy is enhanced In accordance with an embodiment of the present invention, a vapor chamber is provided. The vapor chamber includes a first plate, a second plate, a first capillary strip, a first communication structure and a working medium. The first plate and the second plate are combined together. An accommodation space is defined by the first plate and the second plate collaboratively. The first capillary strip is installed in the accommodation space and clamped between the first plate and the second plate. The accommodation space is divided into at least one first region and at least one second region by the first capillary strip. A first communication structure is formed in the first capillary strip. The first communication structure is in communication with the first region and the second region. The working medium is accommodated within the accommodation space. The working medium flows between the first region and the second region through the first communication structure.

In an embodiment, the first communication structure is formed in a whole segment of the first capillary strip or formed in a partial segment of the first capillary strip.

In an embodiment, the first capillary strip includes a lower part and an upper part. The lower part of the first capillary strip is in contact with the first plate. The upper part of the first capillary strip is in contact with the second plate.

In an embodiment, the first communication structure includes plural first notches. The plural first notches are concavely formed in the upper part of the first capillary strip and extended to the lower part of the first capillary strip. The plural first notches are in communication with the first region and the second region.

In an embodiment, the plural first notches do not run through the lower part of the first capillary strip, so that the lower part of the first capillary strip is maintained as an integral structure.

In an embodiment, the working medium flows between the first region and the second region through the plural first notches.

In an embodiment, the first plate further includes a first capillary structure, and the first capillary structure is in contact with the lower part of the first capillary strip.

In an embodiment, the second plate further includes a second capillary structure, and the second capillary structure is in contact with the upper part of the first capillary strip.

In an embodiment, the first communication structure includes plural openings. The plural openings are formed in the first capillary strip. Moreover, the plural openings are in communication with the first region and the second region.

In an embodiment, the vapor chamber further includes plural support posts, which are disposed within the accommodation space and clamped between the first plate and the second plate. The plural support posts are not in contact with the first capillary strip. The plural support posts are aligned with the first communication structure.

In an embodiment, the vapor chamber further includes a second capillary strip and a second communication structure. The second capillary strip is installed in the first region or the second region of the accommodation space. The second communication structure is formed in the second capillary strip.

In an embodiment, the second capillary strip and the first capillary strip are separated from each other. Moreover, the first communication structure and the second communication structure are staggered.

In an embodiment, the accommodation space includes a heat absorption zone and a condensation zone. The first capillary strip is extended from the heat absorption zone to the condensation zone.

In accordance with another embodiment of the present invention, a heat dissipation device with a vapor chamber is provided. The heat dissipation device is in thermal contact with a first heat source. The vapor chamber includes a first plate, a second plate, a first capillary strip, a first communication structure and a working medium. The first plate and the second plate are combined together. An accommodation space is defined by the first plate and the second plate collaboratively. The accommodation space includes a heat absorption zone and a condensation zone. A first capillary strip is installed in the accommodation space and clamped between the first plate and the second plate. The first capillary strip is extended from the heat absorption zone to the condensation zone. The accommodation space is divided into at least one first region and at least one second region by the first capillary strip. The first communication structure is formed in the first capillary strip. The first communication structure is in communication with the first region and the second region. The working medium is accommodated within the accommodation space. The working medium flows between the first region and the second region through the first communication structure. The first heat source is in thermal contact with the vapor chamber and aligned with the heat absorption zone of the accommodation space.

Preferably, after the working medium absorbs heat from the first heat source, the working medium is guided from the heat absorption zone to the condensation zone by the first capillary strip.

In an embodiment, the first communication structure is formed in a whole segment of the first capillary strip or formed in a partial segment of the first capillary strip.

In an embodiment, the vapor chamber further includes a liquid storage structure. The liquid storage structure is installed in the accommodation space, and disposed in or located near the heat absorption zone.

In an embodiment, the first capillary strip includes a lower part and an upper part. The lower part of the first capillary strip is in contact with the first plate. The upper part of the first capillary strip is in contact with the second plate.

In an embodiment, the first communication structure includes plural first notches, and the plural first notches are concavely formed in the upper part of the first capillary strip and extended to the lower part of the first capillary strip. The plural first notches do not run through the lower part of the first capillary strip, so that the lower part of the first capillary strip is maintained as an integral structure. The plural first notches are in communication with the first region and the second region.

In an embodiment, the working medium flows between the first region and the second region through the plural first notches.

In an embodiment, the first plate further includes a first capillary structure, and the first capillary structure is in contact with the lower part of the first capillary strip.

In an embodiment, the second plate further includes a second capillary structure, and the second capillary structure is in contact with the upper part of the first capillary strip.

In an embodiment, the first communication structure includes plural openings. The plural openings are formed in the first capillary strip. The plural openings are in communication with the first region and the second region.

In an embodiment, the vapor chamber further includes plural support posts, which are disposed within the accommodation space and clamped between the first plate and the second plate. The plural support posts are not in contact with the first capillary strip. The plural support posts are aligned with the first communication structure.

In an embodiment, the vapor chamber further includes a second capillary strip and a second communication structure. The second capillary strip is installed in the first region or the second region of the accommodation space. The second communication structure is formed in the second capillary strip. The second capillary strip and the first capillary strip are separated from each other. Moreover, the first communication structure and the second communication structure are staggered.

In an embodiment, the heat dissipation device is in thermal contact with a second heat source. The second heat source is in thermal contact with the vapor chamber and aligned with the heat absorption zone of the accommodation space. The second heat source and the first heat source are separated from each other.

From the above descriptions, the vapor chamber includes a working medium, a capillary strip and a communication structure. The communication structure is formed in the capillary strip. After the working medium absorbs the heat, the working medium is guided to a heat-dissipating site by the capillary strip. When the working medium passes through the communication structure, a flow-mixing purpose is achieved. Consequently, the speed of releasing the heat from the working medium is increased, the temperature within the vapor chamber is distributed uniformly, and the heat-dissipating efficacy is enhanced.

The above objects and advantages of the present invention will become more readily apparent to those ordinarily skilled in the art after reviewing the following detailed description and accompanying drawings, in which:

DETAILED DESCRIPTION OF THE PREFERRED EMBODIMENT

The present invention will now be described more specifically with reference to the following embodiments and accompanying drawings.

Figure 1:
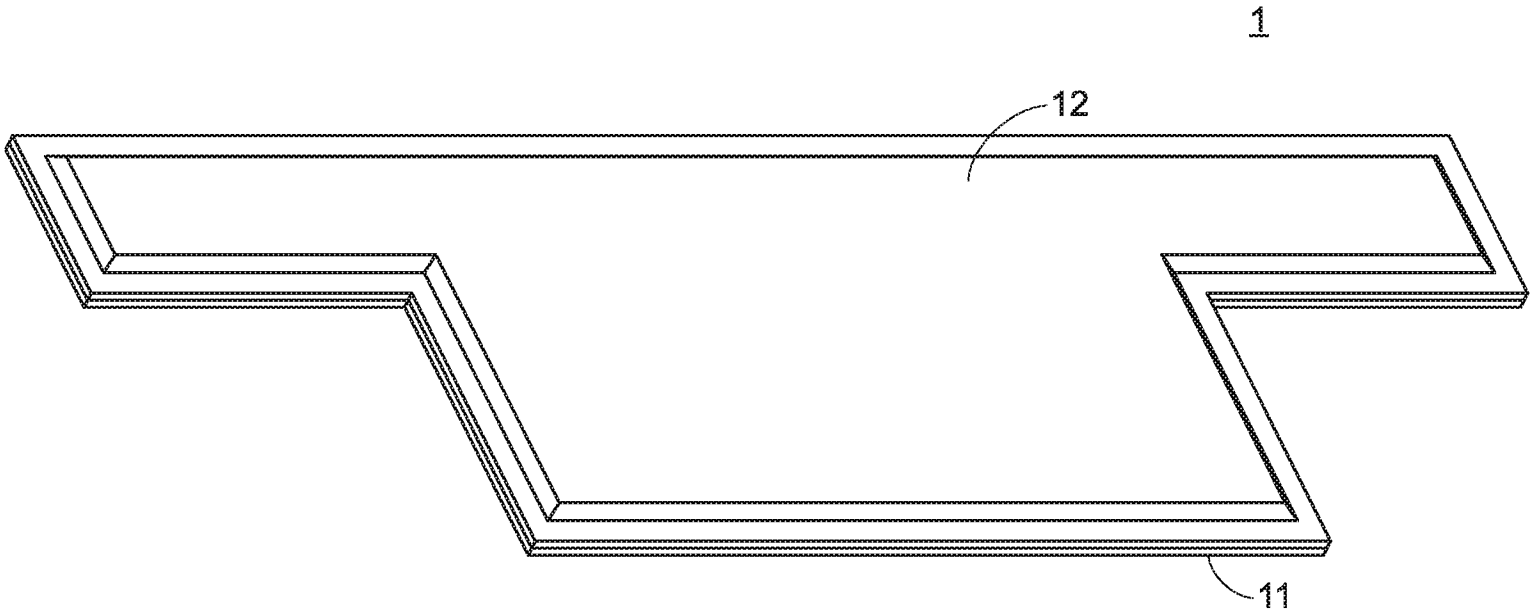
FIG. 1 is a schematic perspective view illustrating a vapor chamber according to a first embodiment of the present invention.
Figure 2:
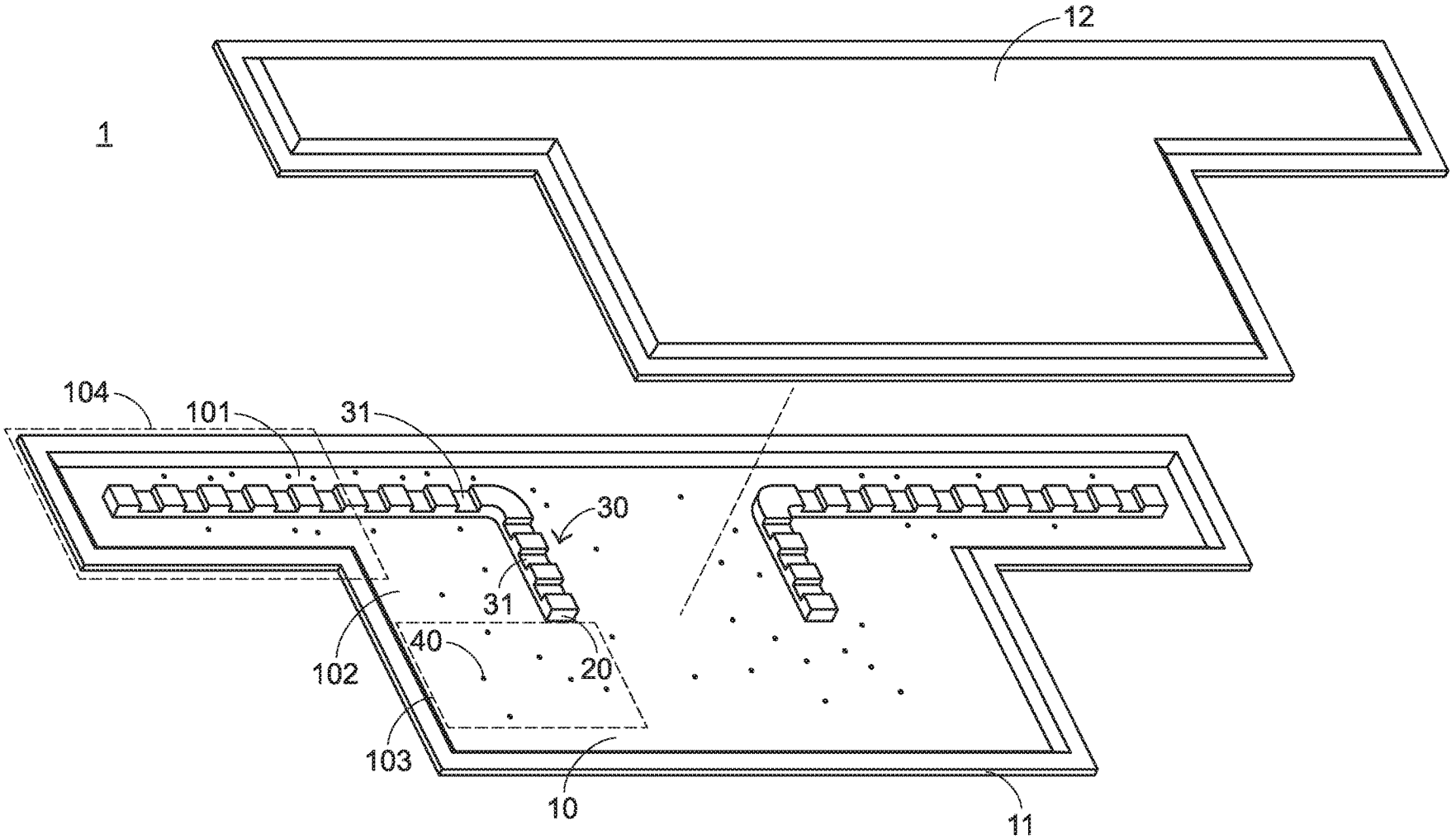
FIG. 2 is a schematic exploded view illustrating the vapor chamber according to the first embodiment of the present invention, in which the first communication structure is formed in a whole segment of the first capillary strip.
Figure 3:
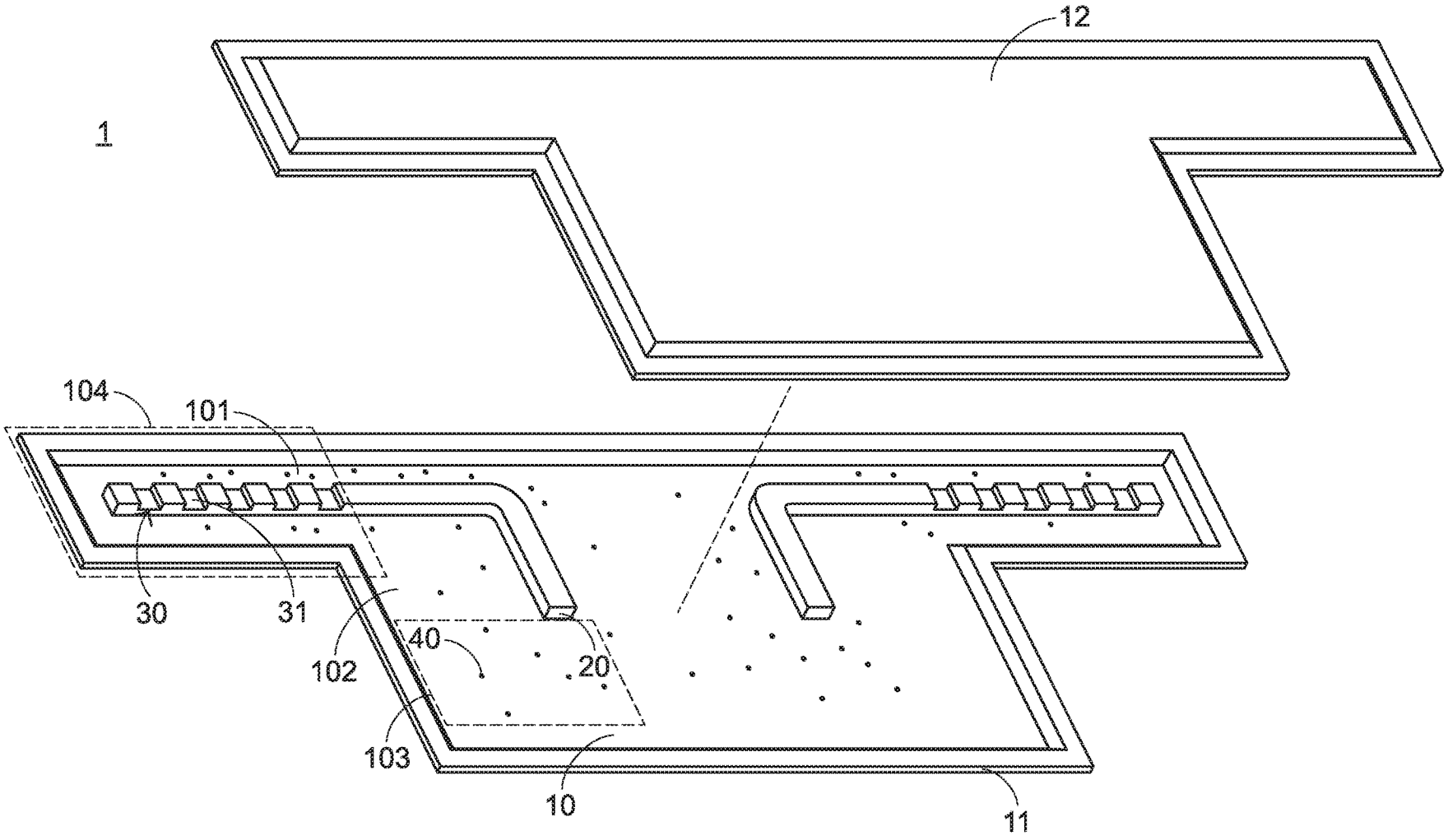
FIG. 3 is a schematic exploded view illustrating a variant example of the vapor chamber according to the first embodiment of the present invention, in which the first communication structure is formed in a partial segment of the first capillary strip.

A first embodiment of the present invention will be described as follows. FIG. 1 is a schematic perspective view illustrating a vapor chamber according to a first embodiment of the present invention. FIG. 2 is a schematic exploded view illustrating the vapor chamber according to the first embodiment of the present invention, in which the first communication structure is formed in a whole segment of the first capillary strip. FIG. 3 is a schematic exploded view illustrating a variant example of the vapor chamber according to the first embodiment of the present invention, in which the first communication structure is formed in a partial segment of the first capillary strip.

In this embodiment, the vapor chamber 1 comprises an accommodation space 10, a first plate 11, a second plate 12, a first capillary strip 20, a first communication structure 30 and a working medium 40. The accommodation space 10 includes a heat absorption zone 103 and a condensation zone 104. The first communication structure 30 comprises plural first notches 31. The first plate 11 and the second plate 12 are combined together. In addition, the accommodation space 10 is defined by the first plate 11 and the second plate 12 collaboratively. The first capillary strip 20 is installed in the accommodation space 10 and clamped between the first plate 11 and the second plate 12. Moreover, the first capillary strip 20 is extended from the heat absorption zone 103 to the condensation zone 104 of the accommodation space 10. By the first capillary strip 20, the accommodation space 10 is divided into a first region 101 and a second region 102. The first communication structure 30 is formed in the first capillary strip 20. Moreover, the first communication structure 30 is in communication with the first region 101 and the second region 102. Especially, the plural first notches 31 of the first communication structure 30 are concavely formed in the first capillary strip 20. Consequently, the plural first notches 31 can be in communication with the first region 101 and the second region 102. The working medium 40 is accommodated within the accommodation space 10. Moreover, the working medium 40 flows between the first region 101 and the second region 102 through the first communication structure 30.

In the example of FIG. 2, the first communication structure 30 is formed in a whole segment of the first capillary strip 20. It is noted that numerous modifications and alterations may be made while retaining the teachings of the invention. For example, in the variant example of FIG. 3, the first communication structure 30 is formed in a partial segment of the first capillary strip 20. As shown in FIG. 2, the first communication structure 30 is formed in a whole segment of the first capillary strip 20, and the first communication structure 30 is extended from the heat absorption zone 103 to the condensation zone 104. As shown in FIG. 3, the first communication structure 30 is formed in the portion of the first capillary strip 20 corresponding to the condensation zone 104. For illustration in the following embodiments, the first communication structure 30 is formed in a whole segment of the first capillary strip 20.

Figure 4:
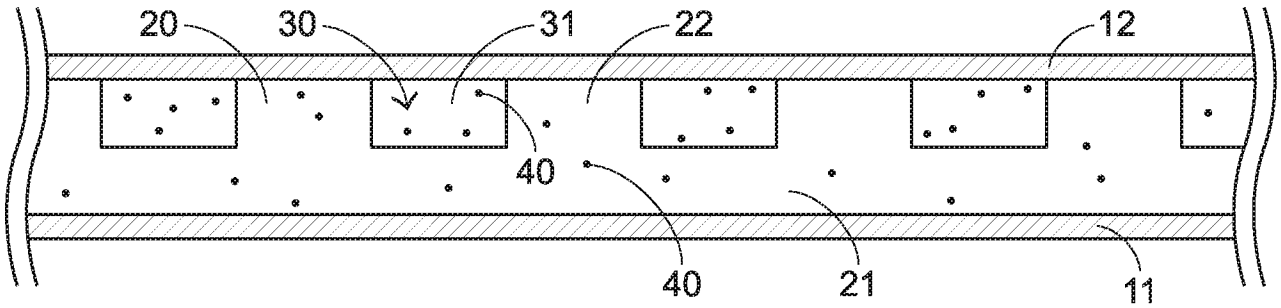
FIG. 4 is a schematic cross-sectional view illustrating the first plate, the second plate and the first capillary strip of the vapor chamber according to the first embodiment of the present invention.

FIG. 4 is a schematic cross-sectional view illustrating the first plate, the second plate and the first capillary strip of the vapor chamber according to the first embodiment of the present invention. Hereinafter, the first capillary strip 20 and the first communication structure 30 will be described in more details with reference to FIGS. 2 and 4. The first capillary strip 20 comprises a lower part 21 and an upper part 22. The lower part 21 of the first capillary strip 20 is contacted with and attached on the first plate 11. The upper part 22 of the first capillary strip 20 is contacted with and attached on the second plate 12. The first capillary strip 20 can support the first plate 11 and the second plate 12. Consequently, the accommodation space 10 between the first plate 11 and the second plate 12 can be maintained. The plural first notches 31 of the first communication structure 30 are extended from the upper part 22 to the lower part 21 of the first capillary strip 20. Moreover, the plural first notches 31 are in communication with the first region 101 and the second region 102. Since the plural first notches 31 do not run through the lower part 21 of the first capillary strip 20, the lower part 21 of the first capillary strip 20 is maintained as an integral structure. The working medium 40 flows between the first region 101 and the second region 102 through the plural first notches 31. Moreover, the working medium 40 can be fed into the first capillary strip 20 and transferred through the lower part 21 of the first capillary strip 20.

Figure 5:
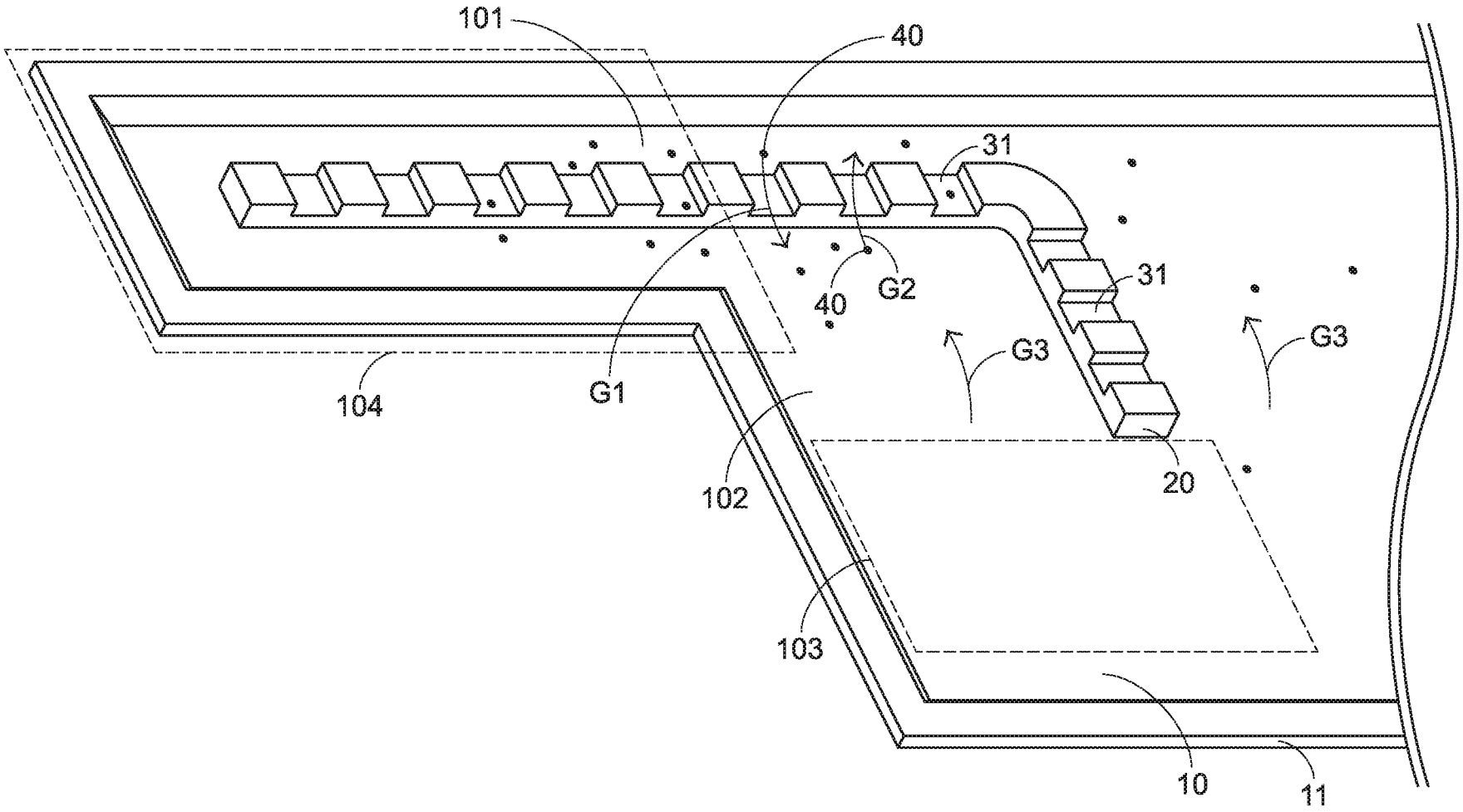
FIG. 5 is a schematic perspective view illustrating a portion of the vapor chamber according to the first embodiment of the present invention.

The flowing condition of the working medium 40 will be described as follows. FIG. 5 is a schematic perspective view illustrating a portion of the vapor chamber according to the first embodiment of the present invention. After the working medium 40 absorbs the heat, the working medium 40 is transformed from the liquid state to the vaporous state. After the working medium 40 in the vaporous state releases the heat, the working medium 40 condenses. Consequently, the working medium 40 is transformed from the vaporous state to the liquid state. After the working medium 40 in the heat absorption zone 103 of the accommodation space 10 absorbs the heat, the working medium 40 is transformed from the liquid state to the vaporous state. Consequently, the working medium 40 diffuses in the accommodation space 10. By the first capillary strip 20, the working medium 40 is guided or limited to flow along a heat-dissipation direction G3. The heat-dissipation direction G3 is extended from the heat absorption zone 103 to the condensation zone 104. Since the working medium 40 is guided or limited by the first capillary strip 20, the working medium 40 can flow to the condensation zone 104 more quickly. When the working medium 40 in the condensation zone 104 releases heat, the heat dissipating purpose is achieved. Moreover, since the working medium 40 diffuses in the accommodation space 10 is a non-uniform manner, the distribution of the working medium 40 in the first region 101 and the second region 102 is not uniform. For example, a greater portion of the working medium 40 is possibly accumulated in the first region 101, and a smaller portion of the working medium 40 is retained in the second region 102. Alternatively, a greater portion of the working medium 40 is possibly accumulated in the second region 102, and a smaller portion of the working medium 40 is retained in the first region 101.

As mentioned above, the plural first notches 31 of the first communication structure 30 overlying the first capillary strip 20 are in communication with the first region 101 and the second region 102. Consequently, a first mixed-flow direction G1 and a second mixed-flow direction G2 are defined by the plural first notches 31. The first mixed-flow direction G1 is the direction extending from the first region 101 to the second region 102. The second mixed-flow direction G2 is the direction extending from the second region 102 to the first region 101. Consequently, the working medium 40 in the first region 101 can flow from the first region 101 to the second region 102 through the first notches 31 along the first mixed-flow direction G1, and the working medium 40 in the second region 102 can flow from the second region 102 to the first region 101 through the first notches 31 along the second mixed-flow direction G2. Since the flowing efficacy and the diffusion efficacy of the working medium 40 are increased, the heat dissipating performance is enhanced. After the working medium 40 in the condensation zone 104 releases the heat and the working medium 40 is transformed from the vaporous state to the liquid state, the working medium 40 is absorbed by the first capillary strip 20. Consequently, the working medium 40 is returned to the neighboring position of the heat absorption zone 103 along the lower part 21 of the first capillary strip 20.

Figure 6:
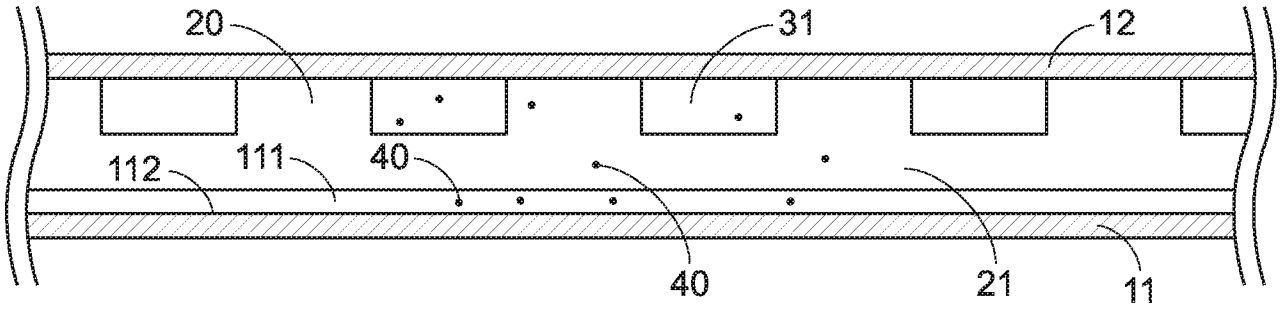
FIG. 6 is a schematic cross-sectional view illustrating a first plate, a second plate and a first capillary strip of a vapor chamber according to a second embodiment of the present invention.

A second embodiment of the present invention will be described as follows. FIG. 6 is a schematic cross-sectional view illustrating a first plate, a second plate and a first capillary strip of a vapor chamber according to a second embodiment of the present invention. The structures and functions of the components of the vapor chamber which are identical to those of the first embodiment are not redundantly described herein. In comparison with the first embodiment, the first plate 11 of the vapor chamber of this embodiment further comprises a first capillary structure 111. The first capillary structure 111 is disposed on a first inner surface 112 of the first plate 11 and attached on the lower part 21 of the first capillary strip 20. The working medium 40 in the liquid state can flow into the first capillary structure 111. The first capillary structure 111 can assist the first capillary strip 20 in transferring the liquid working medium 40. Consequently, the efficiency of transferring the liquid working medium 40 is enhanced.

Figure 7:
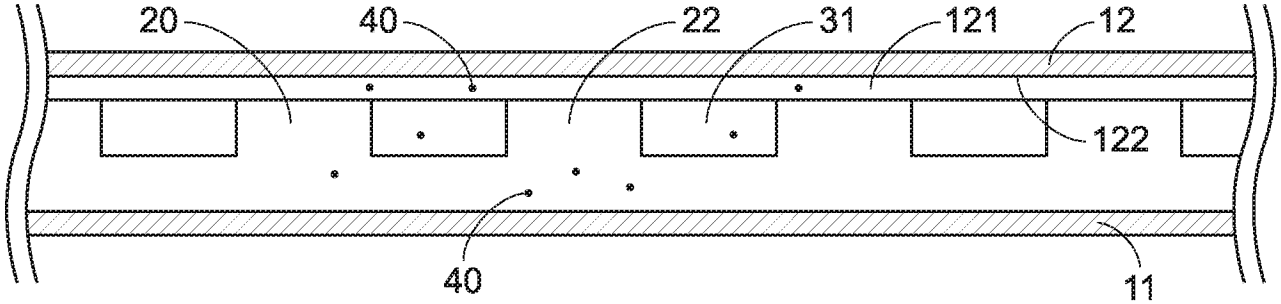
FIG. 7 is a schematic cross-sectional view illustrating a first plate, a second plate and a first capillary strip of a vapor chamber according to a third embodiment of the present invention.

A third embodiment of the present invention will be described as follows. FIG. 7 is a schematic cross-sectional view illustrating a first plate, a second plate and a first capillary strip of a vapor chamber according to a third embodiment of the present invention. The structures and functions of the components of the vapor chamber which are identical to those of the first embodiment are not redundantly described herein. In comparison with the first embodiment, the second plate 12 of this embodiment further comprises a second capillary structure 121. The second capillary structure 121 is disposed on a second inner surface 122 of the second plate 12 and attached on the upper part 22 of the first capillary strip 20. The working medium 40 in the liquid state can flow into the second capillary structure 121. The second capillary structure 121 can assist the first capillary strip 20 in transferring the liquid working medium 40. Consequently, the efficiency of transferring the liquid working medium 40 is enhanced.

Figure 8:
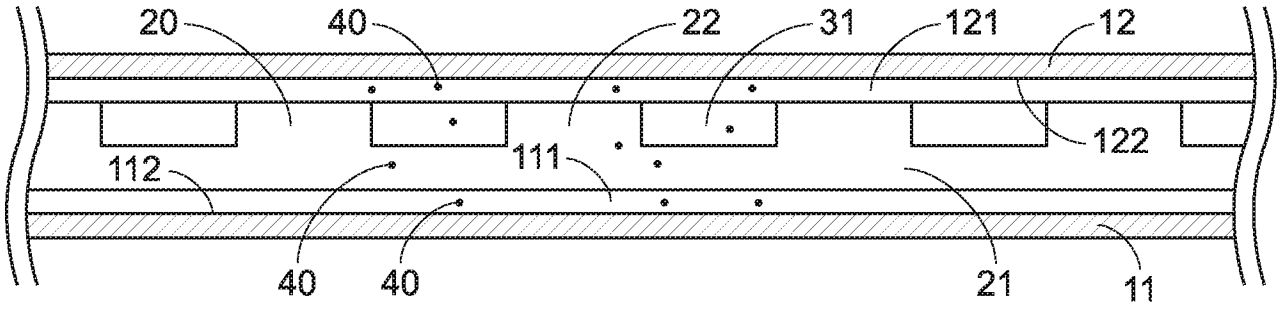
FIG. 8 is a schematic cross-sectional view illustrating a first plate, a second plate and a first capillary strip of a vapor chamber according to a fourth embodiment of the present invention.

A fourth embodiment of the present invention will be described as follows. FIG. 8 is a schematic cross-sectional view illustrating a first plate, a second plate and a first capillary strip of a vapor chamber according to a fourth embodiment of the present invention. The structures and functions of the components of the vapor chamber which are identical to those of the first embodiment are not redundantly described herein. In comparison with the first embodiment, the first plate 11 of this embodiment further comprises a first capillary structure 111, and the second plate 12 of the vapor chamber of this embodiment further comprises a second capillary structure 121. The first capillary structure 111 is disposed on a first inner surface 112 of the first plate 11 and attached on the lower part 21 of the first capillary strip 20. The second capillary structure 121 is disposed on a second inner surface 122 of the second plate 12 and attached on the upper part 22 of the first capillary strip 20. That is, the first capillary strip 20 is clamped between the first capillary structure 111 and the second capillary structure 121. The working medium 40 in the liquid state can flow into the first capillary structure 111 and the second capillary structure 121. The first capillary structure 111 and the second capillary structure 121 can assist the first capillary strip 20 in transferring the liquid working medium 40. Consequently, the efficiency of transferring the liquid working medium 40 is enhanced.

Figure 9:
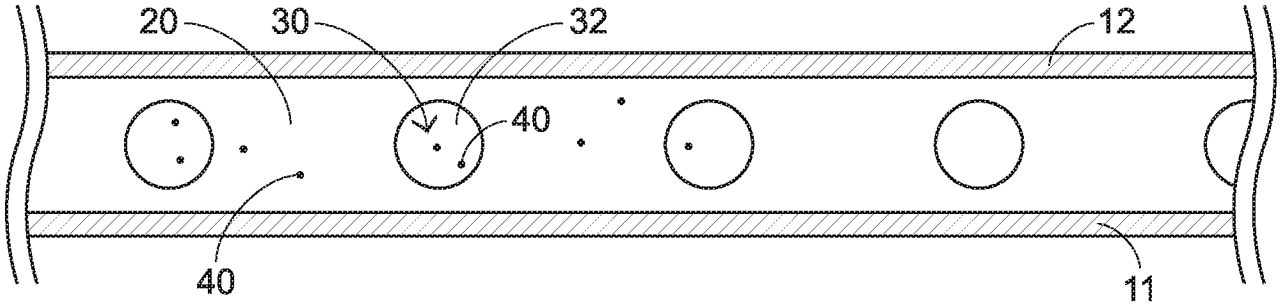
FIG. 9 is a schematic cross-sectional view illustrating a first plate, a second plate and a first capillary strip of a vapor chamber according to a fifth embodiment of the present invention.
Figure 10:
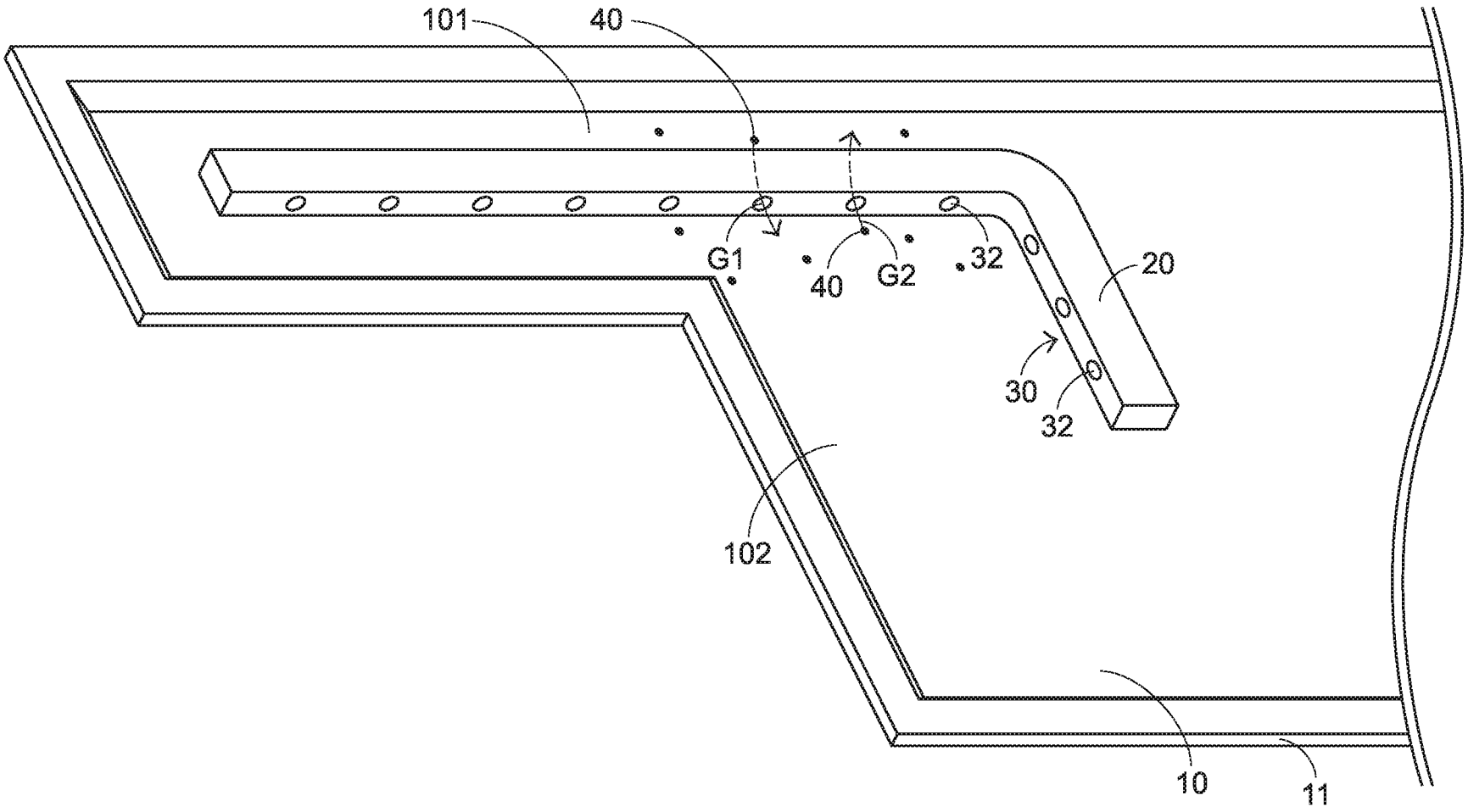
FIG. 10 is a schematic perspective view illustrating a portion of the vapor chamber according to the fifth embodiment of the present invention.

A fifth embodiment of the present invention will be described as follows. FIG. 9 is a schematic cross-sectional view illustrating a first plate, a second plate and a first capillary strip of a vapor chamber according to a fifth embodiment of the present invention. FIG. 10 is a schematic perspective view illustrating a portion of the vapor chamber according to the fifth embodiment of the present invention. The structures and functions of the components of the vapor chamber which are identical to those of the first embodiment are not redundantly described herein. In comparison with the first embodiment, the first communication structure 30 of the vapor chamber of this embodiment comprises plural openings 32. The openings 32 are disposed within the first capillary strip 20. The openings 32 are in communication with the first region 101 and the second region 102. Moreover, the openings 32 are not in contact with the first plate 11 or the second plate 12. The working medium 40 within the accommodation space 10 can flow between the first region 101 and the second region 102 through the openings 32 and along the first mixed-flow direction G1 or the second mixed-flow direction G2.

Figure 11:
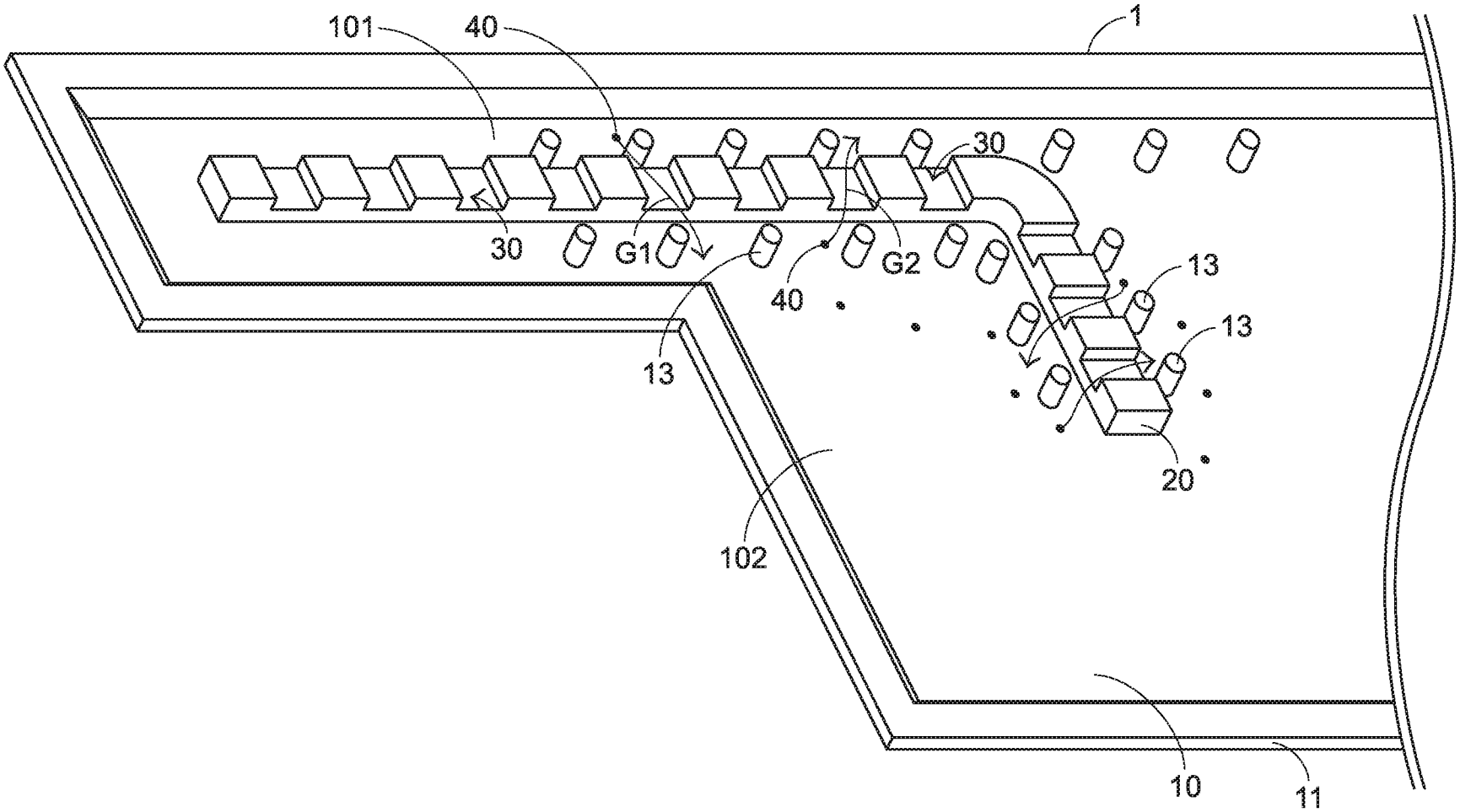
FIG. 11 is a schematic perspective view illustrating a portion of a vapor chamber according to a sixth embodiment of the present invention.

A sixth embodiment of the present invention will be described as follows. FIG. 11 is a schematic perspective view illustrating a portion of a vapor chamber according to a sixth embodiment of the present invention. The structures and functions of the components of the vapor chamber which are identical to those of the first embodiment are not redundantly described herein. In comparison with the first embodiment, the vapor chamber of this embodiment further comprises plural support posts 13. The support posts 13 are disposed within the accommodation space 10 and clamped between the first plate 11 and the second plate 12 (not shown in FIG. 11). The support posts 13 are not in contact with the first capillary strip 20. Some of the support posts 13 are aligned with the first communication structure 30. That is, some of the support posts 13 are arranged beside the first notches 31 of the first communication structure 30. While the working medium 40 flows between the first region 101 and the second region 102 along the first mixed-flow direction G1 or the second mixed-flow direction G2, the working medium 40 flows across the support posts 13 beside the first communication structure 30. Since the efficacy of dispersing the working medium 40 is increased, the flowing uniformity of the working medium 40 is enhanced. The support posts 13 are used for supporting the accommodation space 10. As a consequence, the accommodation space 10 is not readily suffered from deformation. For example, the support posts 13 are capillary powder posts or metal posts.

Figure 12:
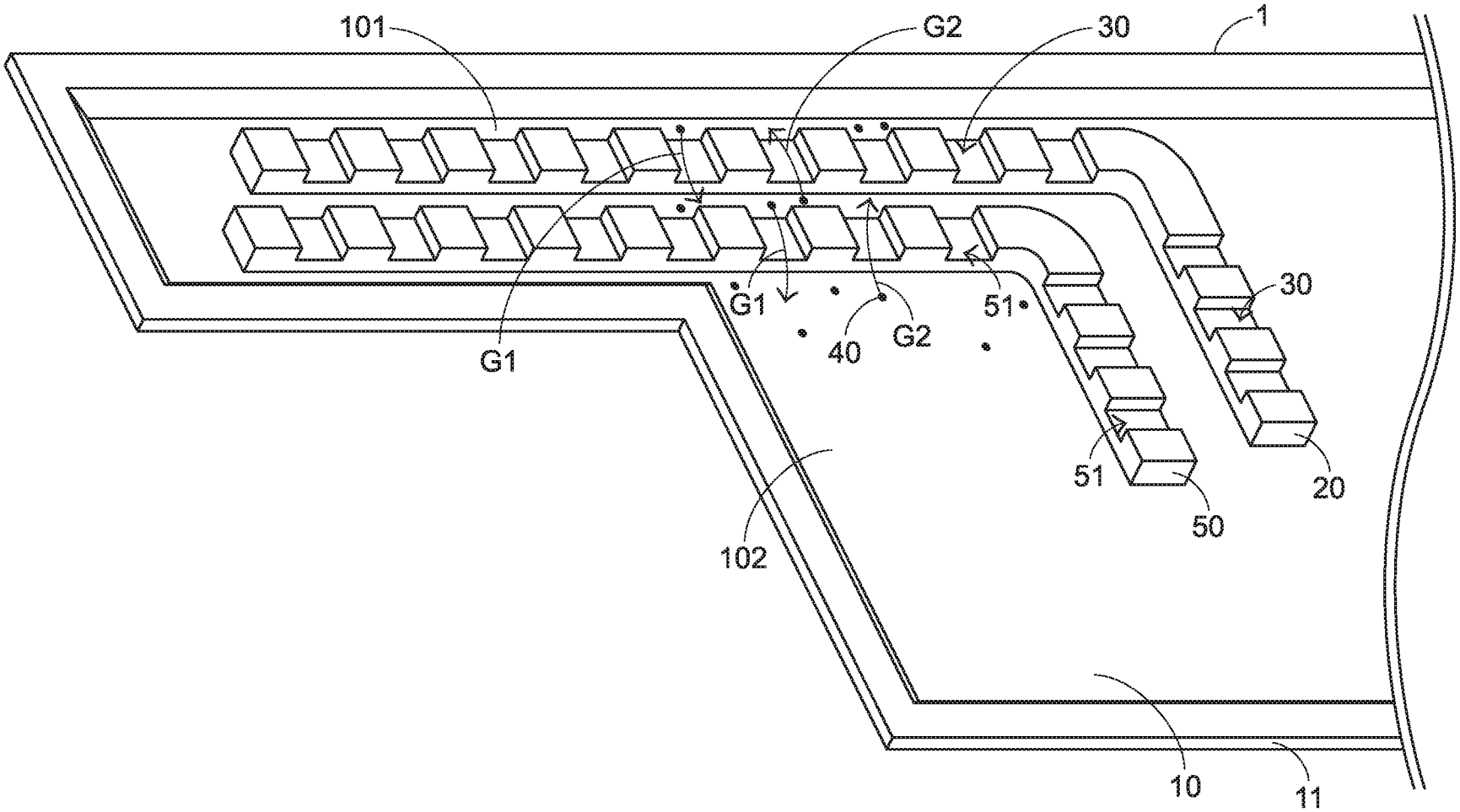
FIG. 12 is a schematic perspective view illustrating a portion of a vapor chamber according to a seventh embodiment of the present invention.

A seventh embodiment of the present invention will be described as follows. FIG. 12 is a schematic perspective view illustrating a portion of a vapor chamber according to a seventh embodiment of the present invention. The structures and functions of the components of the vapor chamber which are identical to those of the first embodiment are not redundantly described herein. Like the first embodiment, the vapor chamber of this embodiment comprises the first capillary strip 20 and the first communication structure 30. In comparison with the first embodiment, the vapor chamber of this embodiment further comprises a second capillary strip 50 and a second communication structure 51. The second capillary strip 50 is aligned with the first capillary strip 20. The second communication structure 51 is formed in the second capillary strip 50. By the first capillary strip 20, the accommodation space 10 is divided into a first region 101 and a second region 102. The second capillary strip 50 is disposed in the first region 101 or the second region 102. In this embodiment, the second capillary strip 50 is disposed in the second region 102. The structure of the second capillary strip 50 is identical to the structure of the first capillary strip 20. The second capillary strip 50 and the first capillary strip 20 are separated from each other. The second communication structure 51 and the first communication structure 30 are separated from each other. Moreover, plural second notches of the second communication structure 51 are concavely formed in the second capillary strip 50. The second notches of the second communication structure 51 are not aligned with the first notches of the first communication structure 30. That is, the second notches of the second communication structure 51 and the first notches of the first communication structure 30 are staggered. While the working medium 40 flows between the first region 101 and the second region 102 along the first mixed-flow direction G1 or the second mixed-flow direction G2, the working medium 40 passes through the first communication structure 30 and the second communication structure 51 and flows through the first communication structure 30 and the second communication structure 51 in an interlaced manner. Consequently, the flowing uniformity of the working medium 40 is enhanced.

Figure 13:
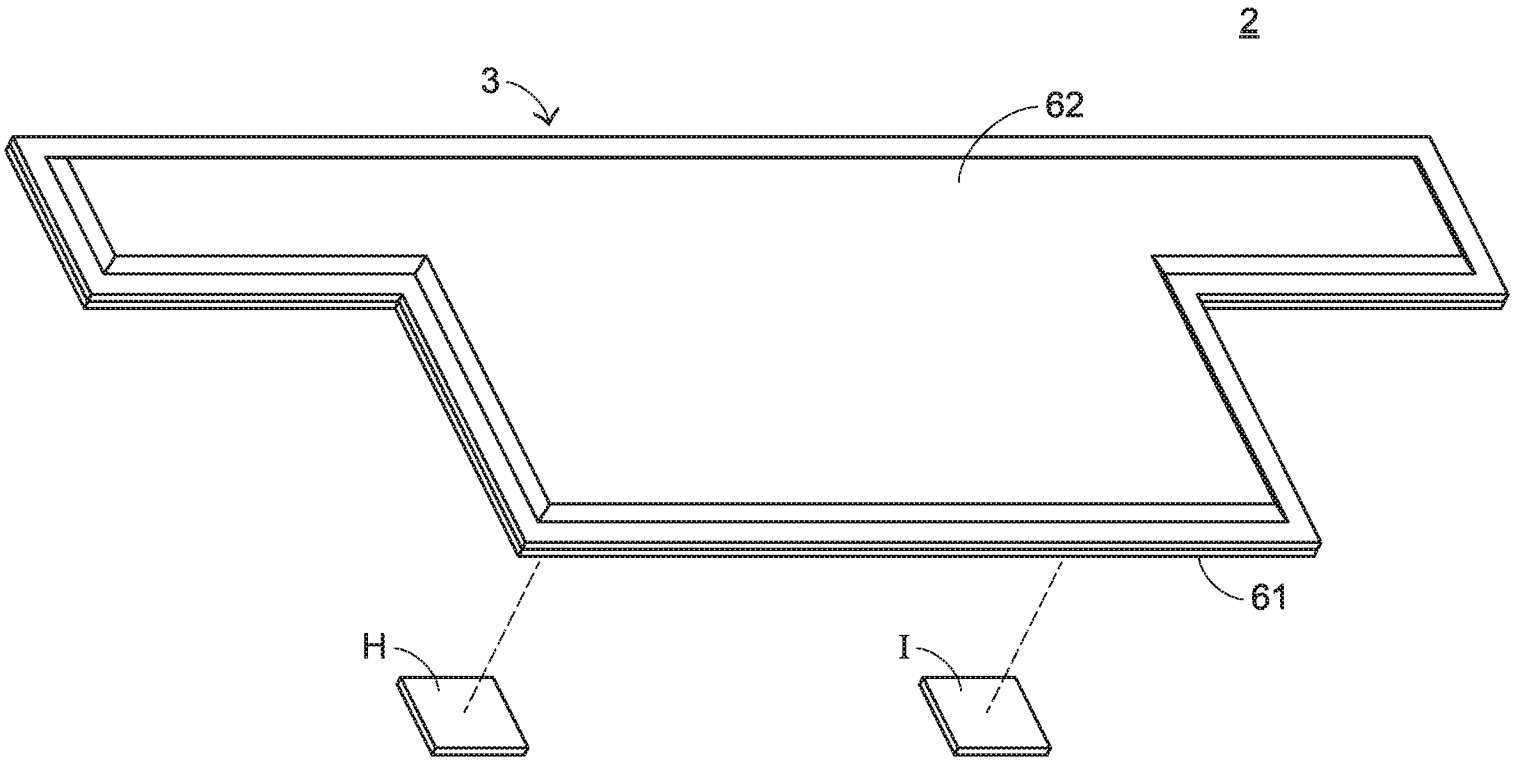
FIG. 13 is a schematic perspective view illustrating a heat dissipation device with a vapor chamber according to an eighth embodiment of the present invention.
Figure 14:
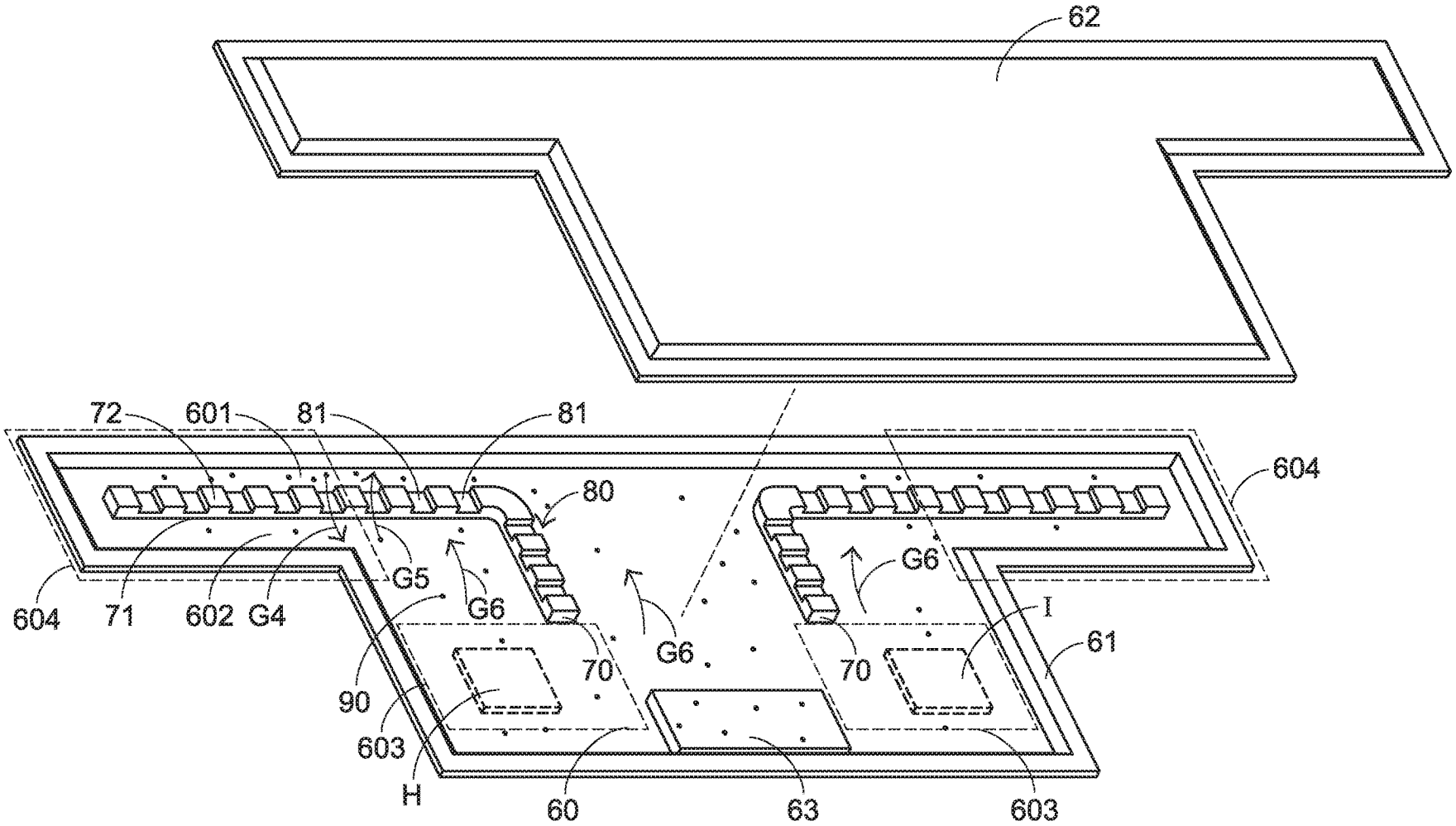
FIG. 14 is a schematic exploded view illustrating the heat dissipation device as shown in FIG. 13.

A heat dissipation device with a vapor chamber will be described as follows. FIG. 13 is a schematic perspective view illustrating a heat dissipation device with a vapor chamber according to an eighth embodiment of the present invention. FIG. 14 is a schematic exploded view illustrating the heat dissipation device as shown in FIG. 13. The heat dissipation device 2 is in thermal contact with a first heat source H and/or a second heat source I. The heat dissipation device 2 comprises a vapor chamber 3. In this embodiment, the vapor chamber 3 comprises an accommodation space 60, a first plate 61, a second plate 62, a first capillary strip 70, a first communication structure 80, a liquid storage structure 63 and a working medium 90. The first plate 61 and the second plate 62 are combined together. In addition, the accommodation space 60 is defined by the first plate 61 and the second plate 62 collaboratively. The accommodation space 60 includes a heat absorption zone 603 and a condensation zone 604. The first capillary strip 70 is installed in the accommodation space 60 and clamped between the first plate 61 and the second plate 62. Moreover, the first capillary strip 70 is extended from the heat absorption zone 603 to the condensation zone 604 of the accommodation space 60. By the first capillary strip 70, the accommodation space 60 is divided into a first region 601 and a second region 602. The first communication structure 80 is formed in the first capillary strip 70. Moreover, the first communication structure 80 is in communication with the first region 601 and the second region 602. The first communication structure 80 is formed in a whole segment of the first capillary strip 70 or formed in a partial segment of the first capillary strip 70. In this embodiment, the first communication structure 80 is formed in a whole segment of the first capillary strip 70. The working medium 90 is accommodated within the accommodation space 60. Moreover, the working medium 90 can flow between the first region 601 and the second region 602 through the first communication structure 80. The liquid storage structure 63 is disposed in or located near the heat absorption zone 603 of the accommodation space 60. In this embodiment, the liquid storage structure 63 is located near the heat absorption zone 603 of the accommodation space 60. The liquid storage structure 63 is configured to store the working medium 90. If the amount of the working medium 90 in the liquid state is insufficient, the working medium 90 in the liquid state is discharged from the liquid storage structure 63. Moreover, after the working medium 90 is transformed from the vaporous state to the liquid state, the working medium 90 in the liquid state is fed into the liquid storage structure 63 for storage. The first heat source H and the second heat source I are in thermal contact with the vapor chamber 3 and aligned with the heat absorption zone 603 of the accommodation space 60. Preferably, the first heat source H and the second heat source I are located near the first capillary strip 70. The first heat source H and the second heat source I are separated from each other. After the heat is transferred from the first heat source H and/or the second heat source I to the vapor chamber 3, the heat is transferred from the first heat source H and/or the second heat source I is absorbed by the working medium 90 in the vapor chamber 3. Consequently, the working medium 90 is transformed from the liquid state to the vaporous state. By the first capillary strip 70, the working medium 90 is guided from the heat absorption zone 603 to the condensation zone 604.

The first capillary strip 70 and the first communication structure 80 will be described in more details as follows. The first capillary strip 70 comprises a lower part 71 and an upper part 72. The lower part 71 of the first capillary strip 70 is contacted with and attached on the first plate 61. The upper part 72 of the first capillary strip 70 is contacted with and attached on the second plate 62. The first capillary strip 70 can support the first plate 61 and the second plate 62. Consequently, the accommodation space 60 between the first plate 61 and the second plate 62 can be maintained. The first communication structure 80 comprises plural first notches 81. The plural first notches 81 of the first communication structure 80 are extended from the upper part 72 to the lower part 71 of the first capillary strip 70. Moreover, the plural first notches 81 are in communication with the first region 601 and the second region 602. Since the plural first notches 81 do not run through the lower part 71 of the first capillary strip 70, the lower part 71 of the first capillary strip 70 is maintained as an integral structure. The working medium 90 can flow between the first region 601 and the second region 602 through the plural first notches 81.

Moreover, the working medium 90 can be fed into the first capillary strip 70 and transferred through the lower part 71 of the first capillary strip 70.

The flowing condition of the working medium 90 will be described as follows. After the working medium 90 absorbs the heat, the working medium 90 is transformed from the liquid state to the vaporous state. After the working medium 90 in the vaporous state releases the heat, the working medium 90 condenses. Consequently, the working medium 90 is transformed from the vaporous state to the liquid state. After the working medium 90 in the heat absorption zone 603 of the accommodation space 60 absorbs the heat, the working medium 90 is transformed from the liquid state to the vaporous state. By the first capillary strip 70, the working medium 90 is guided or limited to flow along a heat-dissipation direction G6. The heat-dissipation direction G6 is extended from the heat absorption zone 603 to the condensation zone 604. Since the working medium 90 is guided or limited by the first capillary strip 70, the working medium 90 can flow to the condensation zone 604 more quickly. When the working medium 90 in the condensation zone 104 releases heat, the heat dissipating purpose is achieved.

As mentioned above, the plural first notches 81 of the first communication structure 80 overlying the first capillary strip 70 are in communication with the first region 601 and the second region 602. Consequently, a first mixed-flow direction G4 and a second mixed-flow direction G5 are defined by the plural first notches 81. The first mixed-flow direction G4 is the direction extending from the first region 601 to the second region 602. The second mixed-flow direction G5 is the direction extending from the second region 602 to the first region 601. Consequently, the working medium 90 in the first region 601 can flow from the first region 601 to the second region 602 through the first notches 81 along the first mixed-flow direction G4, and the working medium 90 in the second region 602 can flow from the second region 602 to the first region 601 through the first notches 81 along the second mixed-flow direction G5. Since the flowing efficacy and the diffusion efficacy of the working medium 90 are increased, the heat dissipating performance is enhanced. After the working medium 90 in the condensation zone 604 releases heat and the working medium 90 is transformed from the vaporous state to the liquid state, the working medium 90 is absorbed by the first capillary strip 70. Consequently, the working medium 90 is returned to the neighboring position of the heat absorption zone 603 along the lower part 71 of the first capillary strip 70. After the working medium 90 is returned to the neighboring position of the heat absorption zone 603, the working medium 90 flows into the heat-dissipation loop again or the working medium 90 is stored in the liquid storage structure 63.

Figure 15:
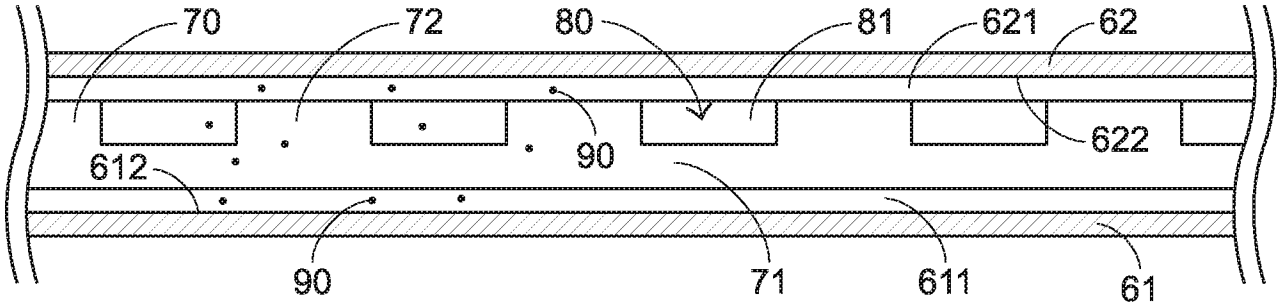
FIG. 15 is a schematic cross-sectional view illustrating a first plate, a second plate and a first capillary strip of a vapor chamber of a heat dissipation device according to a ninth embodiment of the present invention.

A ninth embodiment of the present invention will be described as follows. FIG. 15 is a schematic cross-sectional view illustrating a first plate, a second plate and a first capillary strip of a vapor chamber of a heat dissipation device according to a ninth embodiment of the present invention. The structures and functions of the components of the vapor chamber which are identical to those of the eighth embodiment are not redundantly described herein. In comparison with the eighth embodiment, the first plate 61 of this embodiment further comprises a first capillary structure 611, and the second plate 62 of this embodiment further comprises a second capillary structure 621. The first capillary structure 611 is disposed on a first inner surface 612 of the first plate 61 and attached on the lower part 71 of the first capillary strip 70. The second capillary structure 621 is disposed on a second inner surface 622 of the second plate 62 and attached on the upper part 72 of the first capillary strip 70. That is, the first capillary strip 70 is clamped between the first capillary structure 611 and the second capillary structure 621. The working medium 90 in the liquid state can flow into the first capillary structure 611 and the second capillary structure 621. The first capillary structure 611 and the second capillary structure 621 can assist the first capillary strip 70 in transferring the liquid working medium 90. Consequently, the efficiency of transferring the liquid working medium 90 is enhanced.

Figure 16:
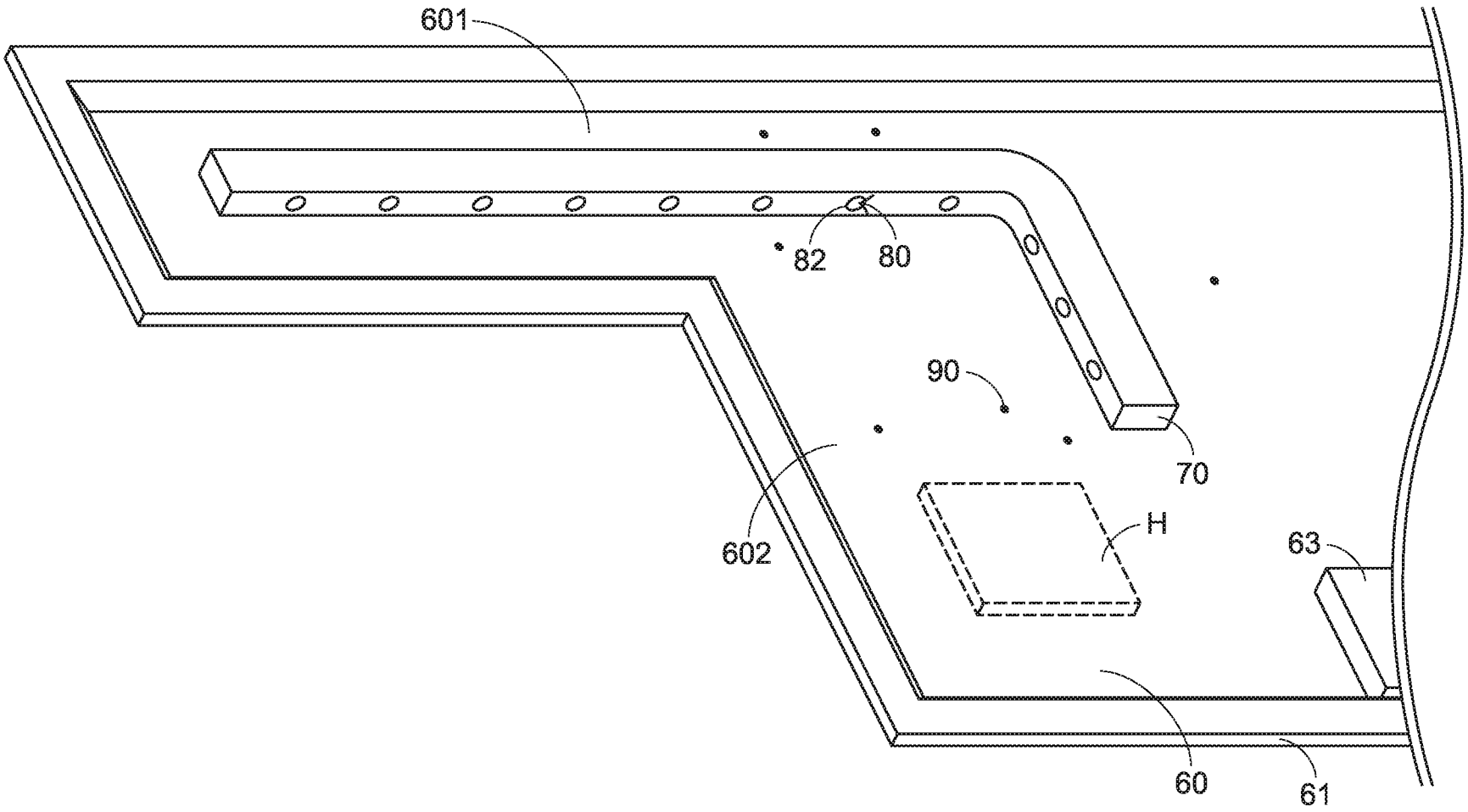
FIG. 16 is a schematic perspective view illustrating a portion of a vapor chamber of a heat dissipation device according to a tenth embodiment of the present invention.

A tenth embodiment of the present invention will be described as follows. FIG. 16 is a schematic perspective view illustrating a portion of a vapor chamber of a heat dissipation device according to a tenth embodiment of the present invention. The structures and functions of the components of the vapor chamber which are identical to those of the eighth embodiment are not redundantly described herein. In comparison with the eighth embodiment, the first communication structure 80 of the vapor chamber of this embodiment comprises plural openings 82. The openings 82 are disposed within the first capillary strip 70. The openings 82 are in communication with the first region 601 and the second region 602. Moreover, the openings 82 are not in contact with the first plate 61 or the second plate 62 (not shown in FIG. 16). The working medium 90 within the accommodation space 10 can pass through the opening 82 and flow between the first region 601 and the second region 602.

Figure 17:
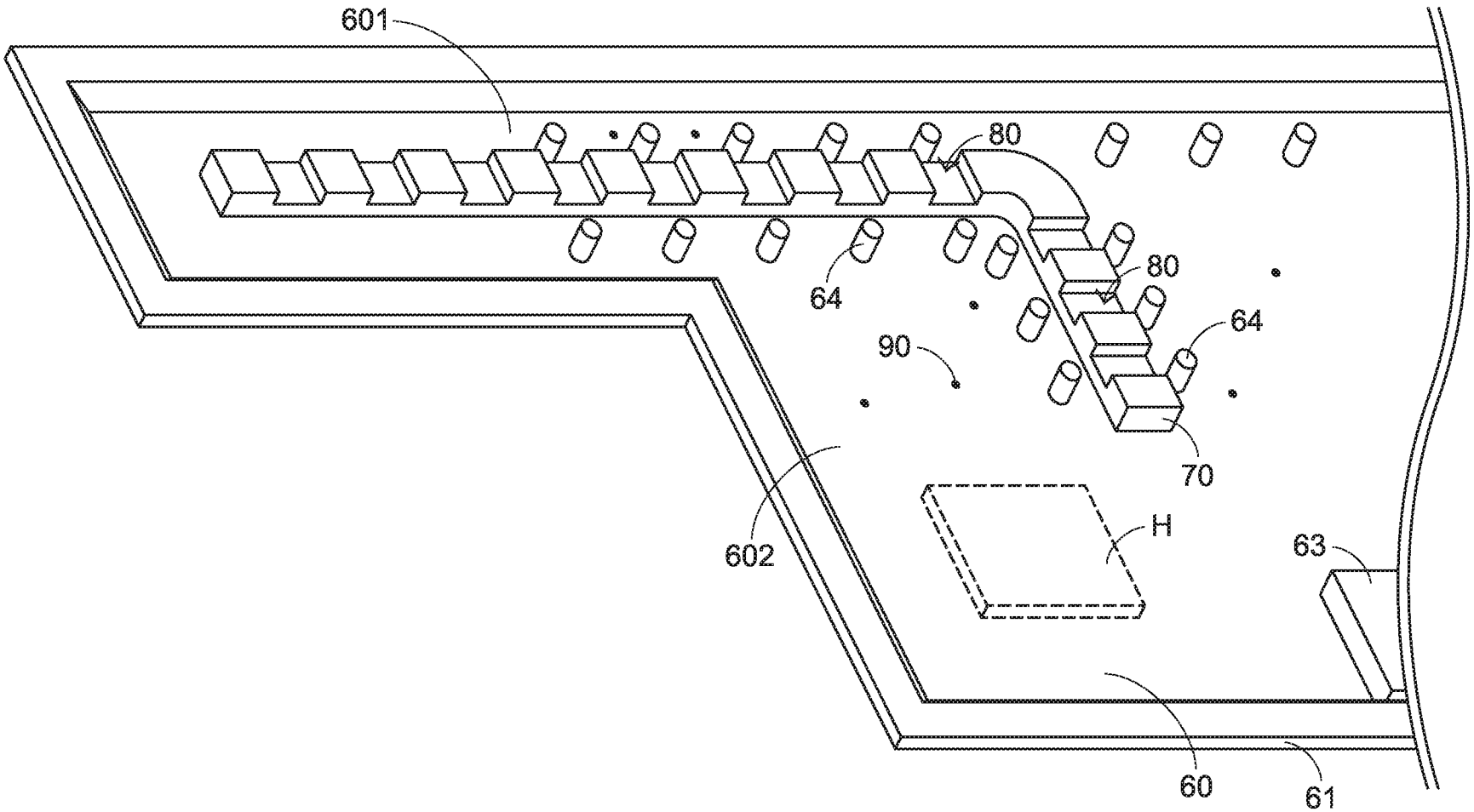
FIG. 17 is a schematic perspective view illustrating a portion of a vapor chamber of a heat dissipation device according to an eleventh embodiment of the present invention.

An eleventh embodiment of the present invention will be described as follows. FIG. 17 is a schematic perspective view illustrating a portion of a vapor chamber of a heat dissipation device according to an eleventh embodiment of the present invention. The structures and functions of the components of the vapor chamber which are identical to those of the eighth embodiment are not redundantly described herein. In comparison with the first embodiment, the vapor chamber of this embodiment further comprises plural support posts 64. The support posts 64 are disposed within the accommodation space 60 and clamped between the first plate 61 and the second plate 62 (not shown in FIG. 17). The support posts 64 are not in contact with the first capillary strip 70. Some of the support posts 64 are aligned with the first communication structure 80. That is, some of the support posts 64 are arranged beside the first notches 81 of the first communication structure 80. While the working medium 90 flows between the first region 601 and the second region 602, the working medium 90 flows across the support posts 64 beside the first communication structure 80. Since the efficacy of dispersing the working medium 90 is increased, the flowing uniformity of the working medium 90 is enhanced. The support posts 64 are used for supporting the accommodation space 60. As a consequence, the accommodation space 60 is not readily suffered from deformation. For example, the support posts 64 are capillary powder posts or metal posts.

Figure 18:
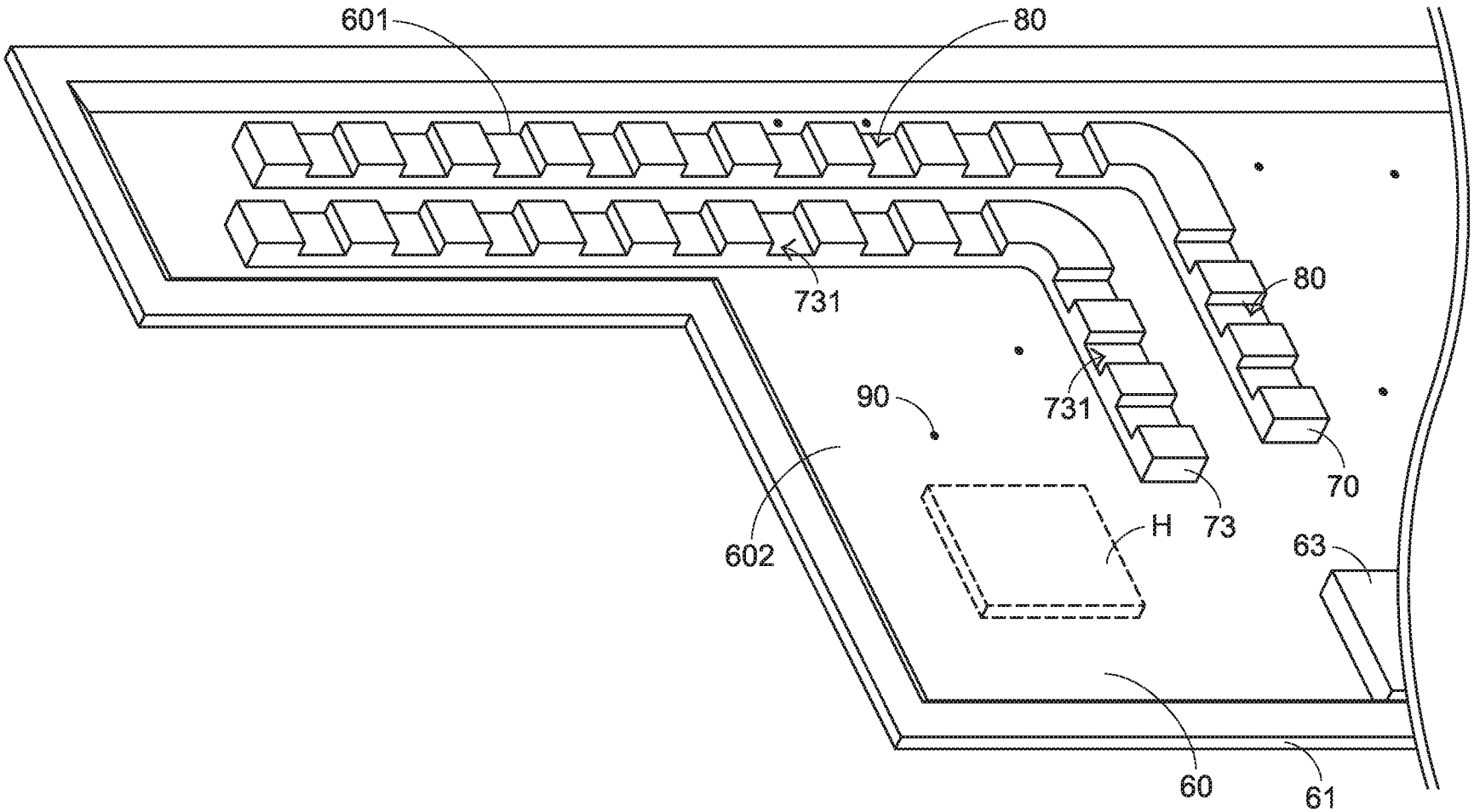
FIG. 18 is a schematic perspective view illustrating a portion of a heat dissipation device according to a twelfth embodiment of the present invention.

A twelfth embodiment of the present invention will be described as follows. FIG. 18 is a schematic perspective view illustrating a portion of a heat dissipation device according to a twelfth embodiment of the present invention. The structures and functions of the components of the heat dissipation device which are identical to those of the eighth embodiment are not redundantly described herein. Like the eighth embodiment, the vapor chamber of this embodiment comprises the first capillary strip 70 and the first communication structure 80. In comparison with the first embodiment, the vapor chamber of this embodiment further comprises a second capillary strip 73 and a second communication structure 731. The second capillary strip 73 is aligned with the first capillary strip 70. The second communication structure 731 is formed in the second capillary strip 73. By the first capillary strip 70, the accommodation space 60 is divided into a first region 601 and a second region 602. The second capillary strip 73 is disposed in the first region 601 or the second region 602. In this embodiment, the second capillary strip 73 is disposed in the second region 602. The structure of the second capillary strip 73 is identical to the structure of the first capillary strip 70. The second capillary strip 73 and the first capillary strip 70 are separated from each other. The second communication structure 731 and the first communication structure 80 are separated from each other. Moreover, plural second notches of the second communication structure 731 are concavely formed in the second capillary strip 70. The second notches of the second communication structure 731 are not aligned with the first notches of the first communication structure 80. That is, the second notches of the second communication structure 731 and the first notches of the first communication structure 80 are staggered. While the working medium 90 flows between the first region 601 and the second region 602, the working medium 90 passes through the first communication structure 80 and the second communication structure 731 and flows through the first communication structure 80 and the second communication structure 731 in an interlaced manner. Consequently, the flowing uniformity of the working medium 90 is enhanced.

In the above embodiments, the vapor chambers 1 and 3 are plate-form heat pipes with the regular and symmetric appearance or asymmetric appearance. Moreover, the vapor chamber can be in thermal contact with at least one heat source (e.g., the heat sources H and I).

While the invention has been described in terms of what is presently considered to be the most practical and preferred embodiments, it is to be understood that the invention needs not be limited to the disclosed embodiments. On the contrary, it is intended to cover various modifications and similar arrangements included within the spirit and scope of the appended claims which are to be accorded with the broadest interpretation so as to encompass all modifications and similar structures.

What is claimed is:

1. A vapor chamber, comprising:

a first plate and a second plate, wherein the first plate and the second plate are combined together, and an accommodation space is defined by the first plate and the second plate collaboratively;

a first capillary strip installed in the accommodation space and clamped between the first plate and the second plate, wherein the accommodation space is divided into at least one first region and at least one second region by the first capillary strip;

a first communication structure formed in the first capillary strip, wherein the first communication structure is in communication with the first region and the second region; and a working medium accommodated within the accommodation space, wherein the working medium flows between the first region and the second region through the first communication structure, wherein the vapor chamber further comprises a second capillary strip and a second communication structure, wherein the second capillary strip is installed in the first region or the second region of the accommodation space, and the second communication structure is formed in the second capillary strip, wherein the second capillary strip and the first capillary strip are separated from each other, and the first communication structure and the second communication structure are staggered.

2. The vapor chamber according to claim 1, wherein the first communication structure is formed in a whole segment of the first capillary strip or formed in a partial segment of the first capillary strip.

3. The vapor chamber according to claim 1, wherein the first capillary strip comprises a lower part and an upper part, wherein the lower part of the first capillary strip is in contact with the first plate, and the upper part of the first capillary strip is in contact with the second plate.

4. The vapor chamber according to claim 3, wherein the first communication structure comprises plural first notches, which are concavely formed in the upper part of the first capillary strip and extended to the lower part of the first capillary strip, wherein the plural first notches are in communication with the first region and the second region.

5. The vapor chamber according to claim 4, wherein the plural first notches do not run through the lower part of the first capillary strip, so that the lower part of the first capillary strip is maintained as an integral structure.

6. The vapor chamber according to claim 4, wherein the working medium flows between the first region and the second region through the plural first notches.

7. The vapor chamber according to claim 3, wherein the first plate further comprises a first capillary structure, and the first capillary structure is in contact with the lower part of the first capillary strip.

8. The vapor chamber according to claim 3, wherein the second plate further comprises a second capillary structure, and the second capillary structure is in contact with the upper part of the first capillary strip.

9. The vapor chamber according to claim 1, wherein the accommodation space includes a heat absorption zone and a condensation zone, wherein the first capillary strip is extended from the heat absorption zone to the condensation zone.

10. A heat dissipation device with a vapor chamber, wherein the vapor chamber comprises:

a first plate and a second plate, wherein the first plate and the second plate are combined together, and an accommodation space is defined by the first plate and the second plate collaboratively, wherein the accommodation space includes a heat absorption zone and a condensation zone;

a first capillary strip installed in the accommodation space and clamped between the first plate and the second plate, wherein the first capillary strip is extended from the heat absorption zone to the condensation zone, and the accommodation space is divided into at least one first region and at least one second region by the first capillary strip;

a first communication structure formed in the first capillary strip, wherein the first communication structure is in communication with the first region and the second region; and a working medium accommodated within the accommodation space, wherein the working medium flows between the first region and the second region through the first communication structure, wherein the vapor chamber further comprises a second capillary strip and a second communication structure, wherein the second capillary strip is installed in the first region or the second region of the accommodation space, the second communication structure is formed in the second capillary strip, and the second capillary strip and the first capillary strip are separated from each other, wherein the first communication structure and the second communication structure are staggered.

11. The heat dissipation device according to claim 10, wherein after the working medium absorbs heat, the working medium is guided from the heat absorption zone to the condensation zone by the first capillary strip.

12. The heat dissipation device according to claim 10, wherein the first communication structure is formed in a whole segment of the first capillary strip or formed in a partial segment of the first capillary strip.

13. The heat dissipation device according to claim 10, wherein the vapor chamber further comprises a liquid storage structure, wherein the liquid storage structure is installed in the accommodation space, and disposed in or located near the heat absorption zone.

14. The heat dissipation device according to claim 10, wherein the first capillary strip comprises a lower part and an upper part, wherein the lower part of the first capillary strip is in contact with the first plate, and the upper part of the first capillary strip is in contact with the second plate.

15. The heat dissipation device according to claim 14, wherein the first communication structure comprises plural first notches, which are concavely formed in the upper part of the first capillary strip and extended to the lower part of the first capillary strip, wherein the plural first notches do not run through the lower part of the first capillary strip, so that the lower part of the first capillary strip is maintained as an integral structure, wherein the plural first notches are in communication with the first region and the second region.

16. The heat dissipation device according to claim 15, wherein the working medium flows between the first region and the second region through the plural first notches.

17. The heat dissipation device according to claim 14, wherein the first plate further comprises a first capillary structure, and the first capillary structure is in contact with the lower part of the first capillary strip.

18. The heat dissipation device according to claim 14, wherein the second plate further comprises a second capillary structure, and the second capillary structure is in contact with the upper part of the first capillary strip.

* * * * *